US009320925B2

(12) United States Patent
Wise

(10) Patent No.: US 9,320,925 B2
(45) **Date of Patent: *Apr. 26, 2016**

(54) FALL ARREST SYSTEM AND LANYARD

(71) Applicant: Tech Safety Lines, Inc., Dallas, TX (US)

(72) Inventor: Brent Wise, Farmersville, TX (US)

(73) Assignee: Tech Safety Lines, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/643,990

(22) Filed: Mar. 10, 2015

(65) Prior Publication Data

US 2015/0182767 A1 Jul. 2, 2015

Related U.S. Application Data

(60) Continuation of application No. 13/626,486, filed on Sep. 25, 2012, now abandoned, which is a division of application No. 11/852,812, filed on Sep. 10, 2007, now Pat. No. 8,292,028.

(60) Provisional application No. 60/825,252, filed on Sep. 11, 2006.

(51) Int. Cl.
*A62B 35/00* (2006.01)
*A62B 35/04* (2006.01)

(52) U.S. Cl.
CPC ..... *A62B 35/04* (2013.01); *A62B 35/0006* (2013.01); *A62B 35/0043* (2013.01); *A62B 35/0075* (2013.01)

(58) Field of Classification Search
CPC ..... A62B 35/0075; A62B 1/16
See application file for complete search history.

(56) References Cited

U.S. PATENT DOCUMENTS

| | | | | |
|---|---|---|---|---|
| 5,090,503 | A * | 2/1992 | Bell | 182/5 |
| 5,738,046 | A * | 4/1998 | Williams et al. | 119/770 |
| 5,848,667 | A * | 12/1998 | Davidson | 182/190 |
| 6,800,007 | B2 * | 10/2004 | Calkin | 441/84 |
| 7,036,628 | B2 * | 5/2006 | Wilcox et al. | 182/9 |
| 7,650,717 | B2 * | 1/2010 | Drayer | 47/32.5 |
| 8,353,386 | B2 * | 1/2013 | Helms | 182/3 |
| 2005/0230184 | A1 * | 10/2005 | Ansaldo | 182/3 |
| 2006/0113147 | A1 * | 6/2006 | Harris, Jr. | 182/3 |

* cited by examiner

*Primary Examiner* — Alvin Chin-Shue

(74) *Attorney, Agent, or Firm* — Vincent J. Allen; Brandon V. Zuniga; Carstens & Cahoon, LLP

(57) ABSTRACT

An improved fall arrest lanyard apparatus and method for decelerating and arresting a user from impacting the ground after a fall, along with an integrated, deployable etrier. After the fall sequence has ended, the user may use the etrier to relieve tension in an upper portion of the lanyard and thereby disconnect the lanyard from the user while suspended.

17 Claims, 9 Drawing Sheets

FALL ARREST SYSTEM AND LANYARD

CROSS-REFERENCE TO RELATED APPLICATIONS

This application is a continuation of U.S. patent application Ser. No. 13/626,486 filed, Sep. 25, 2012, which is a divisional application of U.S. patent application Ser. No. 11/852,812, filed Sep. 10, 2007, which claims the benefit of U.S. Provisional Application No. 60/825,252, filed Sep. 11, 2006, which are all incorporated herein by reference in their entirety.

BACKGROUND OF THE INVENTION

1. Technical Field

The present invention relates generally to a fall safety device for persons working at or scaling heights. More specifically, the present invention relates to method of using an improved lanyard device with an integrated etrier system that functions to reduce suspension trauma to the user.

2. Description of Related Art

Safety harness and lanyard devices and systems are known in the art and are commonly used to provide fall protection for persons subjected to the potential of a fall from height. In the workplace, most fall protection systems incorporate a safety belt or harness and a lanyard for anchoring one end of the fall protection system to an anchor point and the other end of the fall protection system to the safety harness or belt that is worn by the user. The harness and lanyard must be made of material with sufficient strength to support the weight of a user, who after sustaining a fall at height, typically remains suspended above the ground awaiting rescue. However, prior art safety harness and lanyard systems do not include additional accoutrements that provide for the comfort of the user that is suspended in the harness after the fall sequence is over and that assist with the prevention of suspension trauma injuries to the body of the user caused by hanging suspended in a safety harness, for what may be an extended period of time, prior to rescue. Accordingly, providing a fall protection system with the ability to lessen or completely alleviate suspension trauma injury would be of great benefit to users working at height.

Thus, a need exists for an improved safety lanyard device and system that provides a deceleration capability to lessen the force of fall impact on the user which is easily integrated with existing safety harnesses, belts and safety lines. Furthermore, a need exists for an improved safety lanyard which includes an etrier system that is deployed either automatically during the fall sequence or manually by the user after the fall. The etrier system should allow the user to orient himself or herself in a comfortable position while strapped into his or her safety harness, thereby reducing and/or preventing the deleterious effect of suspension trauma on his or her body while awaiting rescue. Additionally, a need exists for an approved safety lanyard that allows a user to perform a weight transfer while suspended such that the user can use a rescue kit to lower himself or herself to safety rather than awaiting rescue.

Further objects of this invention will be apparent to persons knowledgeable with devices of this general type upon reading the following description and examining the accompanying drawings.

SUMMARY OF THE INVENTION

In accordance with the foregoing objects, the present invention includes a method of using a fall arrest lanyard. In one embodiment of the invention the method comprises the steps of connecting a first end of a lanyard assembly to a point on the user wherein the lanyard assembly comprises an etrier in an undeployed configuration between the first end and a second end of the lanyard; connecting a second end of the lanyard assembly to an anchor point; causing the etrier to be moved to a deployed configuration; using the etrier to remove tension on the lanyard assembly in a first length of the lanyard assembly between the first end and a point of attachment of the etrier to the lanyard assembly; and disconnecting the first end of the lanyard assembly from the point on the user while a second length of the lanyard assembly between the point of attachment and the second end remains under tension of the weight of the user.

Many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings wherein:

DETAILED DESCRIPTION OF THE INVENTION

Figure 1:
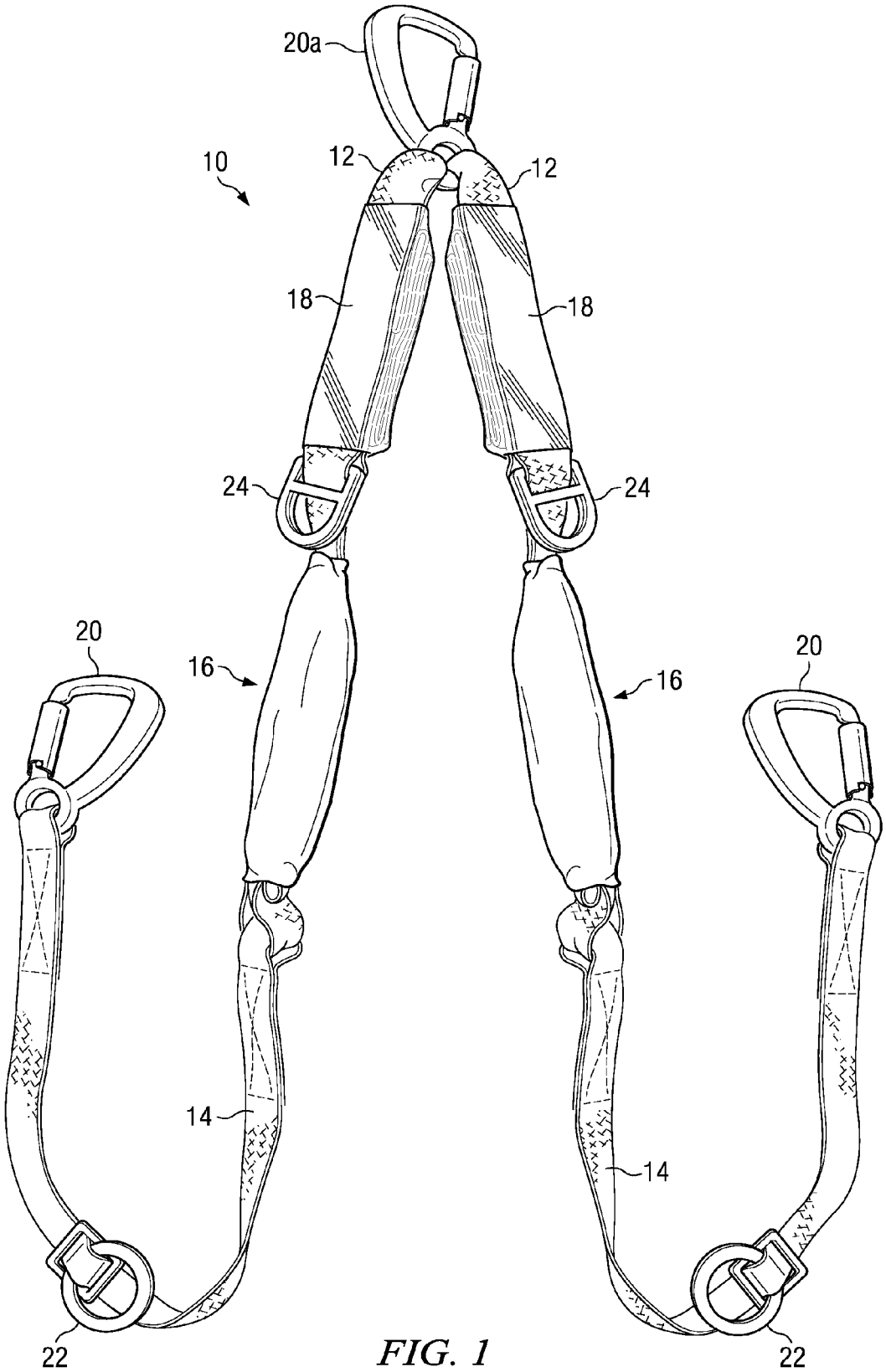
FIG. 1 is plan view of one embodiment of the fall arrest lanyard showing the individual components of same.

A preferred embodiment of the invention is disclosed herein as shown in FIGS. 1 through 3B. FIG. 1 shows the fall arrest lanyard 10 assembly in accordance with an embodiment of the present invention. In this embodiment, the lanyard assembly 10 is comprised of two upper straps 12 connected at one end via universal connectors of sufficient tensile strength, in this instance shown as clamp 20*a*, and two lower straps 14. Upper straps 12 and lower straps 14 are connected via sewn loops as shown in FIG. 1, although alternative connection devices may be utilized including universal clamps, lobster clamps and load bearing rings of requisite tensile strength. Upper straps 12 include a folded etrier 16 secured to each upper strap 12. Etrier packs 16 comprise a length of nylon strap with loops sewed therein that is folded and enclosed in a breakaway sheathing, such as shrink wrap. Etrier packs 16 are shown in the stored position wherein the etriers, a French term used by climbers to denote "step rope ladders," are attached to upper straps 12 by stitching or other connection methods as known in the art. Shock packs 18 comprise a length of folded upper strap 12 which is enclosed in a breakaway sheathing material such as shrink wrap plastic. The sheathing material utilized with etrier packs 16 and shock packs 18 acts to keep the etriers and shock packs in a secure, folded position until the application of sufficient tensile force which overcomes the restrictive force of the sheathing and allows the etriers and shock packs to deploy during a fall sequence. Incorporated and secured to upper straps 12 are cinch buckles 24 which provide an additional attach point for securing tools or other objects as desired by the user. Clamps 20 are positioned at the terminal ends of lower straps 14 for attachment directly to anchor points such as retractable safety lines or fixed anchor components. Sliding buckles 22 are included on each of the lower straps 14 to facilitate attachment to the anchor system.

Figure 2A:
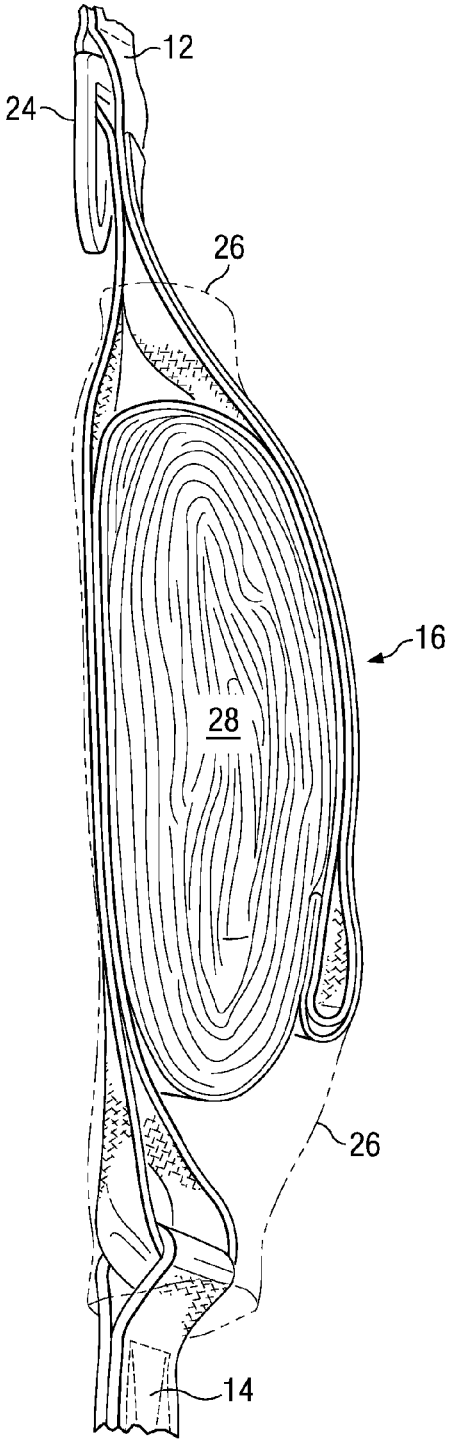
FIGS. 2A-2B is a side view of the etrier shown in the folded, pre-deployment position.
Figure 2B:
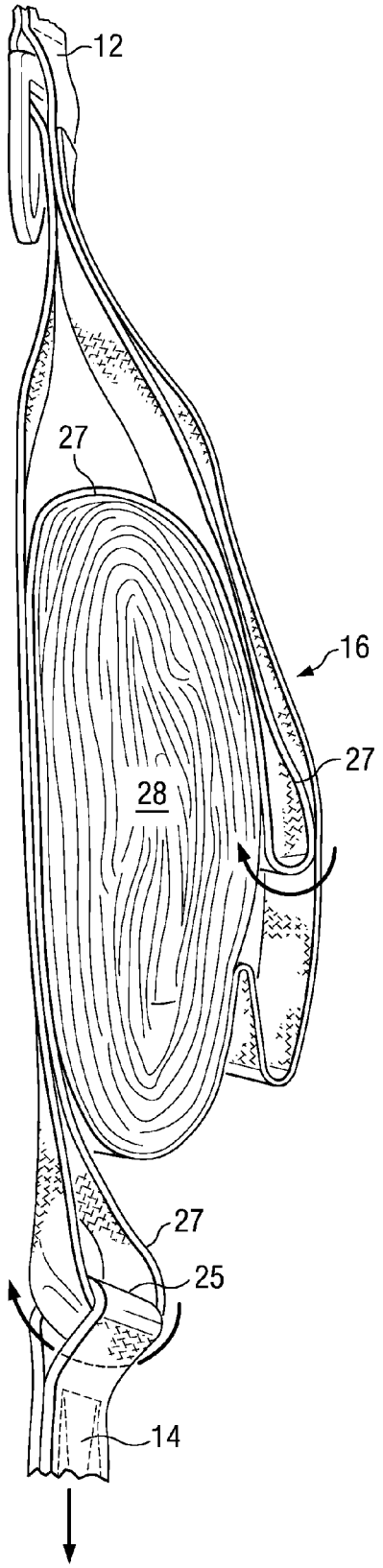

FIG. 2A shows the folded etriers 16 in greater detail in the "stored" position. In this position, the etrier pack 16 is shown folded and retained in the folded position by shrink-wrap type material sheathing 26. The etrier strap 28 is typically anywhere from four to six feet in unfolded length, although shorter or longer lengths may be utilized depending upon the specific application. Sheathing 26 retains the length of strap 28 in a folded state until sufficient tensile force exists between lower strap 14 and upper strap 12 thereby causing the etrier pack 16 to begin deploying along its length. As shown in FIG. 2B, as sufficient tensile force acts across upper strap 12 and lower strap 14, the sheathing 26 breaks away and provides a decelerative force as the etrier pack strap 27 pulls through the loop in the lower strap 14. The action of the strap 27 acts both to provide a declarative force and to deploy the etrier strap 28.

Figure 3A:
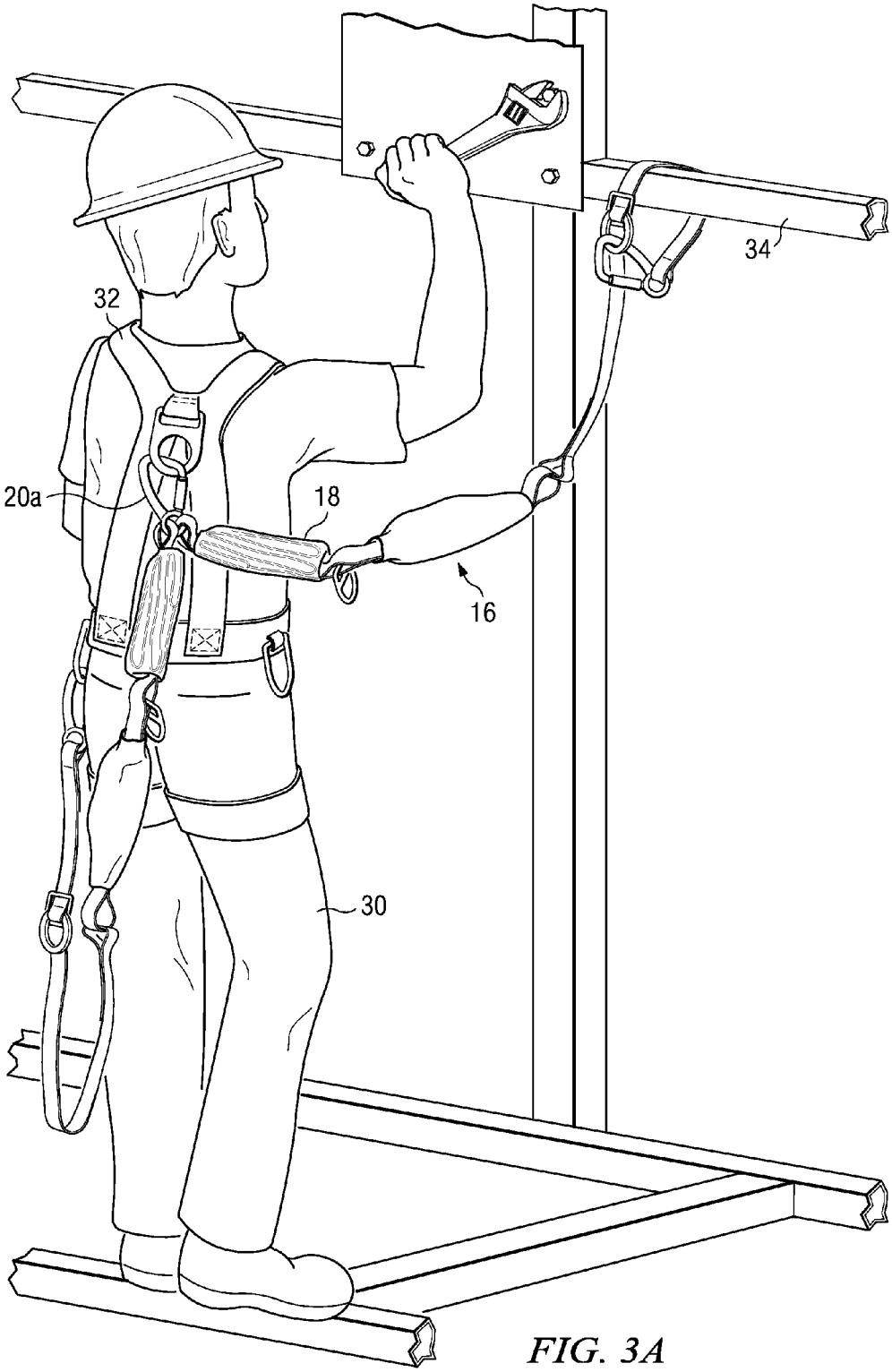
FIG. 3A is a perspective view showing a worker with the fall arrest lanyard attached to a safety harness and attached to an anchor point.
Figure 3B:
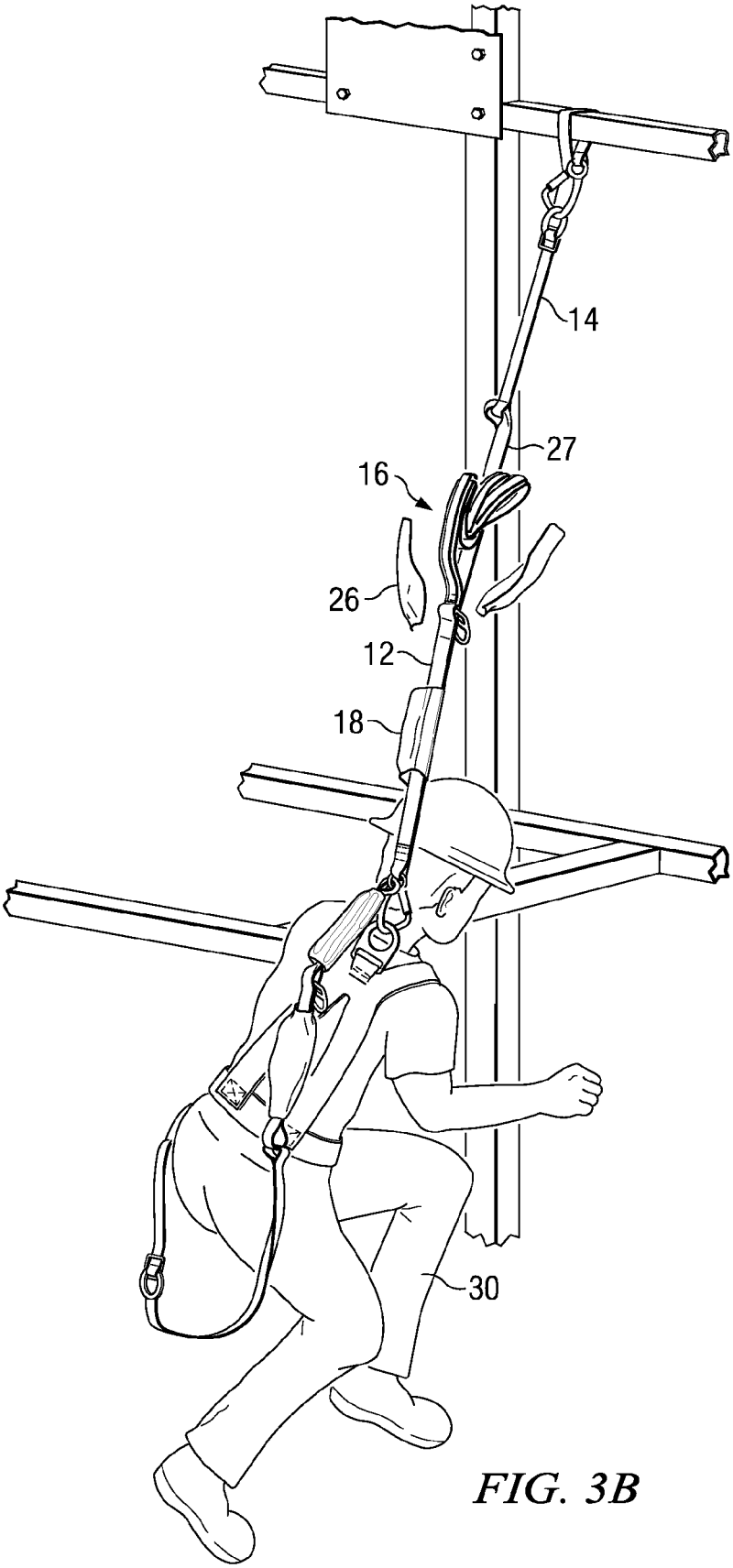
FIG. 3B is a perspective view showing deployment of the fall arrest lanyard during a fall sequence.

FIGS. 3A-3D represent a typical operation of the fall arrest lanyard described herein. In FIG. 3A, a user 30 is shown wearing safety harness 32 as is known in the art. Lanyard assembly 10 is connected to the user's harness 32 via clamp 20A. At least one end of the lanyard assembly 10 is anchored to a secure point such as static beam 34 or to an existing safety line (not shown). FIG. 3B shows the beginning of a fall sequence wherein user 30 has lost his or her footing and begins to fall. As tensile forces begin to act across the upper strap 12 and lower strap 14 of the lanyard assembly 10, the etrier pack 16 deploys. Thereafter, the development of increasingly greater tensile forces across the upper and lower straps of the lanyard assembly 10 triggers activation of the shock pack 18 to resistively release the folded portion of the upper strap 12 contained within the shrink wrap material resulting in the development of a decelerative force acting to slow the fall of the user 30. The user stops falling as the length of upper strap and lower strap is fully deployed.

Figure 3C:
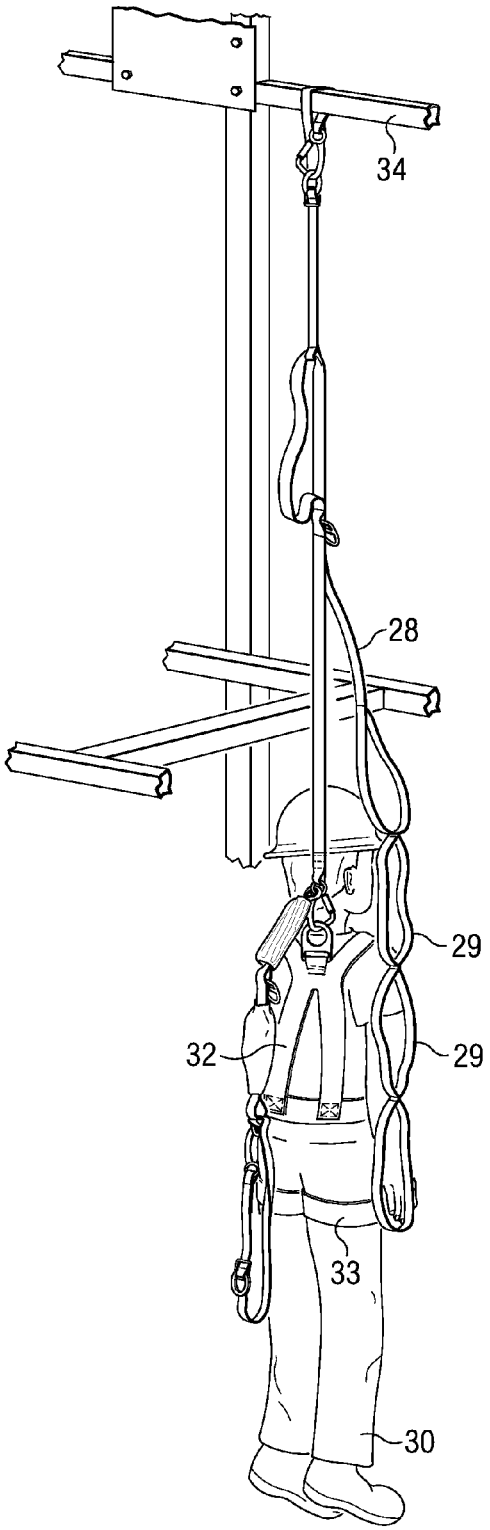
FIG. 3C is a perspective view of the fall arrest lanyard with etrier fully deployed with the user suspended in the safety harness at the end of the fall sequence.
Figure 3D:
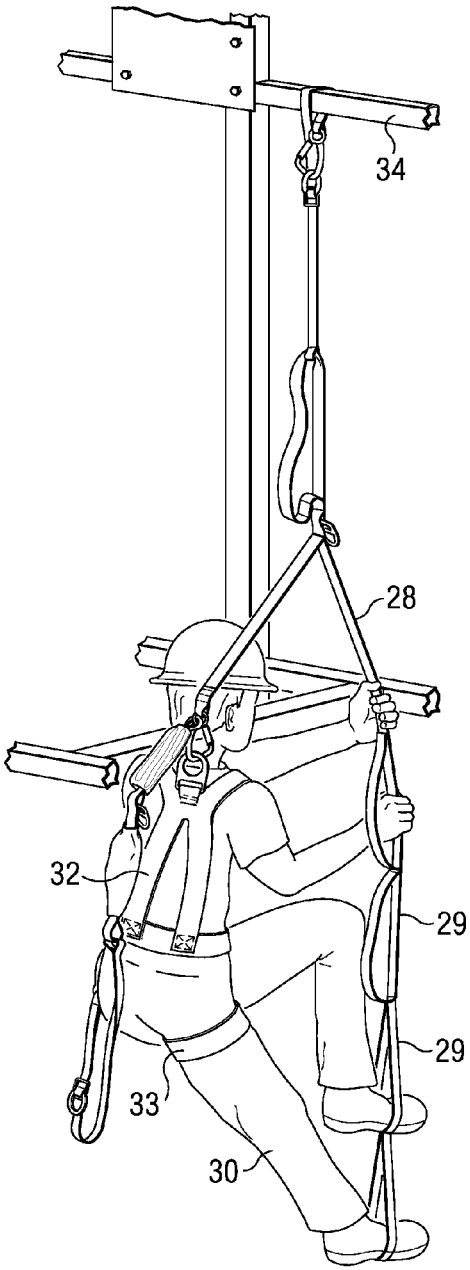
FIG. 3D is a perspective view of the fall arrest lanyard with the user placing his feet within the etrier to assume a comfortable rest position which prevents the onset of suspension trauma injury while awaiting rescue.

FIG. 3C shows the user suspended above the ground after the fall scenario is complete. In this depiction, the weight of the user 30 causes the safety harness 32 with leg straps 33 to act as constriction points on the body of the user 30. This phenomena, known as "suspension trauma," can act to constrict blood flow and decrease circulation which can lead to fatigue, unconsciousness and possibly death if the user is not quickly rescued. However, the deployed etrier 28 provides the user 30 with the ability to independently avoid suspension trauma. As shown in FIGS. 3C and 3D, the etrier 28 includes loops 29 into which the user 30 may insert his or her feet and assume a comfortable sitting or standing position while awaiting rescue and retrieval. This allows the user 30 to remove the pressure from remaining suspended in the harness 32 thereby preventing the onset of suspension trauma while awaiting rescue. Alternatively, the user can take advantage of the weight transfer capability of the manually deployed etrier to lower himself or herself to the ground using a rescue kit as discussed below with regard to an alternative embodiment of the invention.

Figure 4:
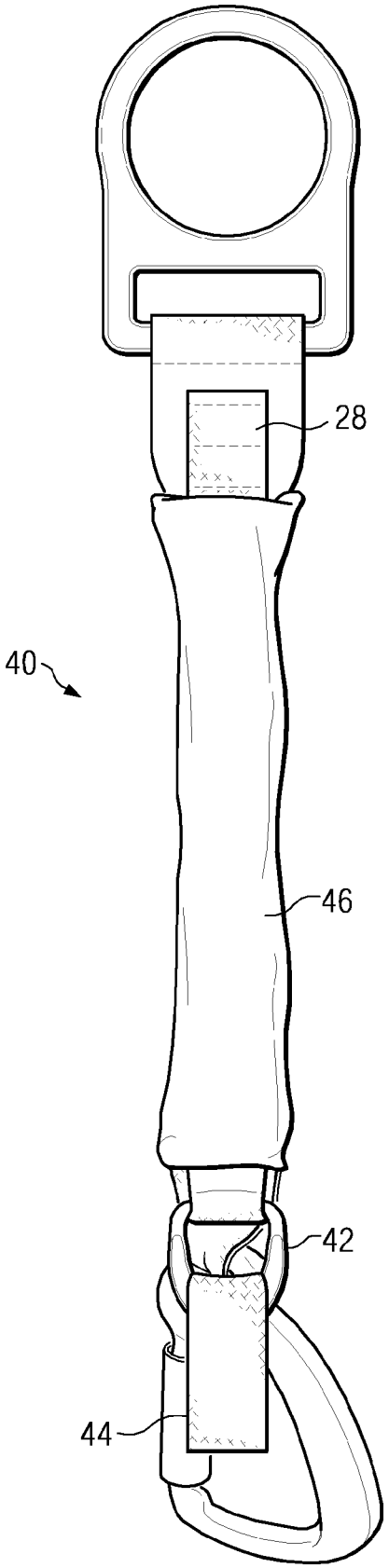
FIG. 4 is a plan view of a fall arrest lanyard showing a manually deployed etrier in accordance with an embodiment of the invention.

Referring now to FIG. 4, a fall arrest lanyard 40 with a manually deployed etrier strap 28 in accordance with an embodiment of the invention as illustrated. In certain situations, the force created as a result of a fall by a user of a safety harness might not be sufficient to deploy the etrier pack discussed with regard to the automatically deployed etrier discussed above. Consequently, it may be desirable to have an etrier that may be manually deployed by the user in the event of a fall. In particular, the use of a self-retracting safety line (SRL) results in the safety line remaining taut while the user is working, for example, on the side of a building. In this situation, the user will be arrested immediately upon falling and will not typically gain enough momentum to deploy either an automatically deployed etrier or a shock pack as discussed above. The manually deployed etrier of FIG. 4 is constructed by sewing an etrier strap 28 to a cow tail strap. The cow tail strap is known in the art and is used to provide an extension to make it easier for the user to attach his or her harness to a lifeline. The distal end of the etrier strap 28 has a small ring 42 and tab 44 to provide a surface that may be easily grasped by the user to manually deploy the etrier strap 28. The etrier strap 28 is folded and a sheath 46 is placed around the folded etrier strap 28 in a manner similar to the manner in which the etrier strap on the automatically deployed etrier discussed above is stored.

Figure 5A:
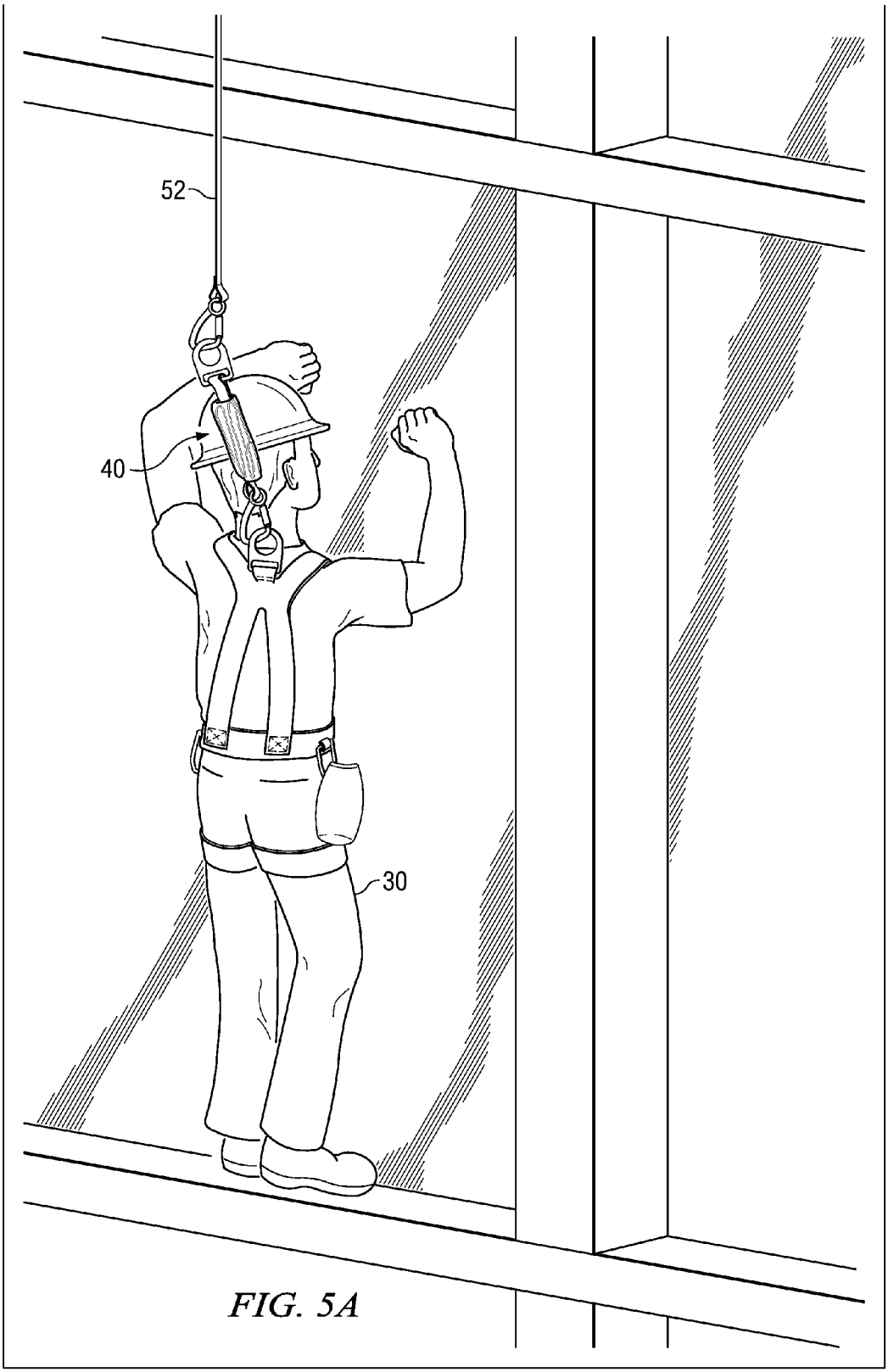
FIG. 5A is a perspective view showing a user with the fall arrest lanyard and manually deployed etrier attached to a safety harness and a self-retracting lifeline.

FIG. 5A shows a perspective view of a worker with the manually deployed etrier 40 attached to the dorsal connection of the user's safety harness. The other end is attached to a self-retracting lifeline (SRL) 52.

Figure 5B:
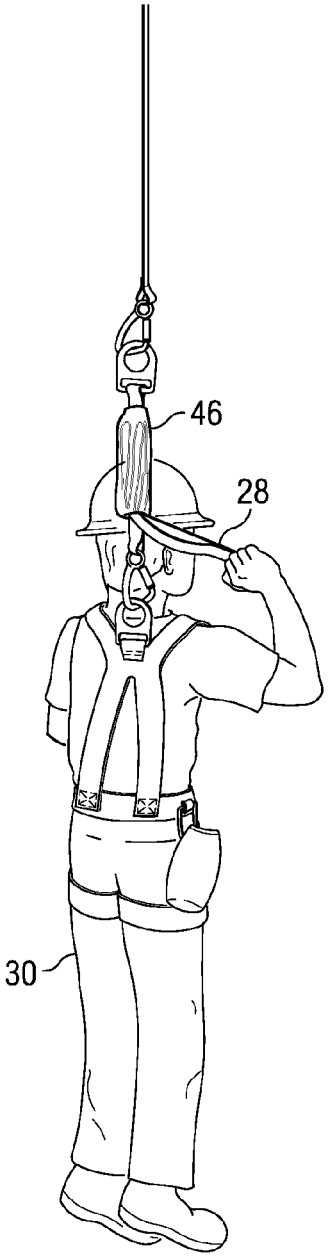
FIG. 5B is a perspective view showing a user suspended from a self-retracting safety line deploying the manually deployed etrier.

FIG. 5B shows the user 30 deploying the etrier 28 by pulling the ring 42 and tab 44 after a fall. As he pulls the etrier, the sheathing 46 breaks and falls off allowing the etrier 28 to fully extend.

Figure 5C:
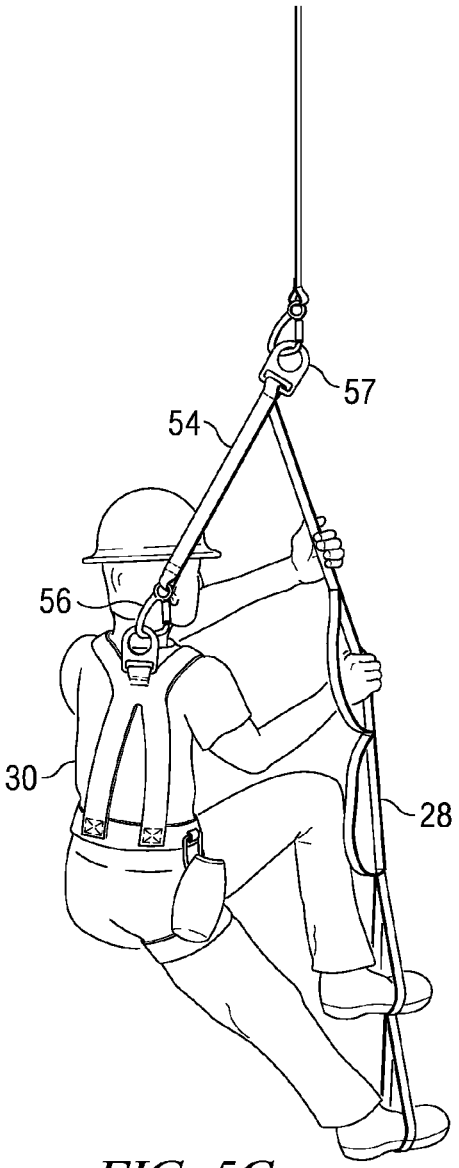
FIG. 5C is a perspective view showing a user climbing the manually deployed etrier.

FIG. 5C shows the user climbing up the etrier after the etrier 28 has been deployed. As the user 30 climbs up the etrier 28, the user 30 can cause the tension in strap 54 to be released so that clamp 56 can be disconnected after a rescue line is attached to the user's harness or belt.

Figure 5D:
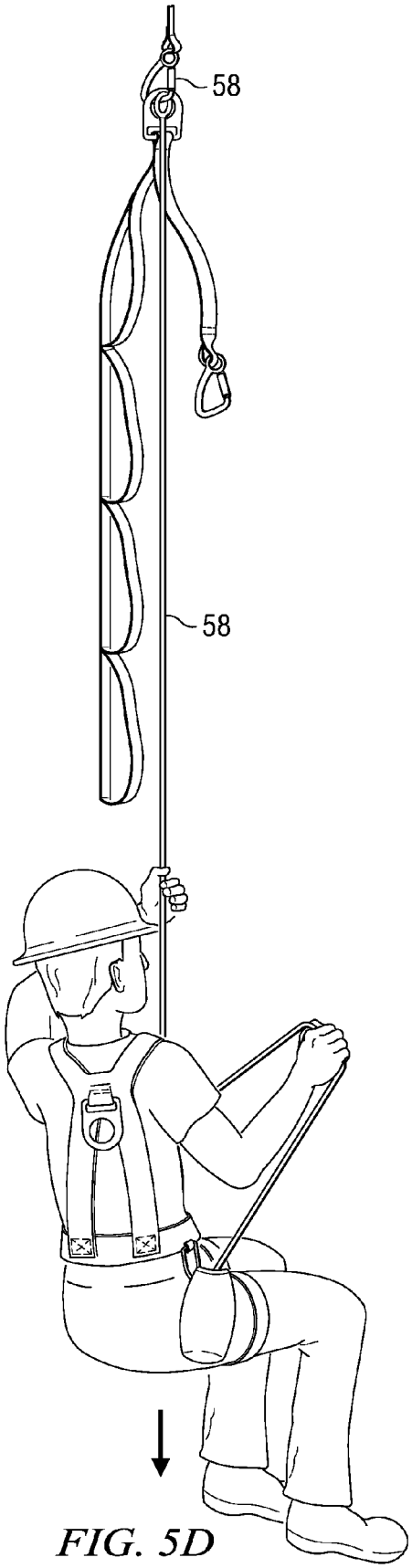
FIG. 5D is a perspective view showing a user lowering himself to the ground after performing a weight transfer using the manually deployed etrier.

FIG. 5D shows the user descending to the ground using a rescue line attached to the clamp 58 at one end and the front of his harness (not shown) to allow the user 30 to lower himself to the ground. In this manner, the user 30 need not await a rescue.

The arrest lanyard and etriers disclosed herein can be manufactured from nylon or polyester materials and plastics as known in the art to sufficient specifications for all applicable OSHA and specific industry safety requirements, including requirements which meet or exceed OSHA 29 CFR 1926.502 and ANSI Z359.1-1992. These materials are abrasion resistant and display excellent durability in all operational environments. In an alternative embodiment, the fall arrest lanyard of the first embodiment disclosed herein may comprise a "single leg" lanyard which incorporates only one upper and lower strap with terminal connection points at the ends of the upper and lower straps, and which includes the shock pack and deployable etrier system disclosed herein.

Although the present invention has been described in terms of an exemplary embodiment, it is not limited to these embodiments and modifications. Alternative embodiments, modifications, and equivalents, which would still be encompassed by the invention, may be made by those of ordinary skill in the art, in light of the foregoing teachings. Therefore, the following claims are intended to cover any alternative embodiments, modifications, or equivalents which may be included within the spirit and scope of the invention defined by the claims.

What is claimed is:

1. A fall arrest system, comprising:

a fall arrest lanyard comprising a first strap with a first connector secured to a proximal end of said first strap for connecting said fall arrest lanyard to a harness for supporting a user after a fall;

a second connector secured to a distal end of said first strap for connecting said fall arrest lanyard to a secure point capable of supporting said user;

a deployable etrier attached to said first strap at a first location spaced from said first connector, said etrier having at least one stirrup that is high enough when said etrier is deployed to allow said user to stand in said stirrup to relieve tension in a section of said first strap below said first location such that said user can disconnect said first connector from said harness after said fall;

a shock pack attached to said first strap;

wherein said second connector comprises a second strap, wherein said second strap comprises a first terminal end secured to said distal end of said first strap and a second terminal end configured for attachment to said secure point; and wherein said first terminal end of said second strap is secured to said distal end of said first strap by a sewn loop through which said distal end of said first strap is looped to allow said first strap to slide through said sewn loop to deploy said etrier during said fall.

2. The fall arrest system of claim 1, further comprising an anchor point located above said first location.

3. The fall arrest system of claim 2, wherein said anchor point is located within reach of said user when said user is standing in said at least one stirrup and when said second terminal end is attached to said secure point, thereby allowing said user to attach a rescue line to said anchor point so, upon disconnecting said fall arrest lanyard from said harness, said user can use said rescue line to escape in a controlled descent from a suspended position after said fall.

4. The fall arrest system of claim 3, further comprising said harness for supporting the user after a fall, wherein said harness comprises a connection point for receiving said rescue line to support said user during said controlled descent.

5. The fall arrest system of claim 1, wherein said etrier is attached to said first strap in a manner such that tension applied to said first strap during said fall causes said etrier to begin deploying.

6. The fall arrest system of claim 1, wherein said etrier is stored inside a first sheathing that keeps said etrier in a secure position until an application of sufficient tensile force which overcomes a restrictive force of said first sheathing and allows said etrier to begin deploying during said fall.

7. The fall arrest system of claim 6, wherein said etrier is stored in a folded state with said first strap folded around and enclosing said etrier within said first sheathing.

8. The fall arrest system of claim 1, wherein said shock pack is attached to said first strap at a second location between said etrier and said first connector.

9. The fall arrest system of claim 1, wherein said fall arrest system is configured so that said etrier deploys prior to deployment of said shock pack.

10. The fall arrest system of claim 1, further comprising an anchor point located between said first location and said second terminal end.

11. The fall arrest system of claim 1, wherein said shock pack is stored inside a sheathing to keep said shock pack in a secure position until an application of sufficient tensile force which overcomes a restrictive force of said sheathing and allows said shock pack to begin deploying during said fall.

12. The fall arrest system of claim 1, wherein said first connector comprises a first load bearing ring and wherein said second terminal end comprises a second load bearing ring.

13. The fall arrest system of claim 1, wherein said etrier comprises a length of nylon material which includes at least one sewn loop.

14. The fall arrest system of claim 1, further comprising said harness wherein said fall arrest harness is separable from said fall arrest lanyard.

15. A fall arrest lanyard comprising;

a first strap;

a first connector secured to a proximal end of said first strap for connecting a proximal end of said fall arrest lanyard to a point on a harness for supporting a user after a fall;

a second connector secured to a distal end of said fall arrest lanyard for connecting said fall arrest lanyard to a secure point capable of supporting said user;

a deployable etrier attached to said fall arrest lanyard at a first location spaced from said first connector, said etrier having at least one stirrup that is high enough when said etrier is deployed to allow said user to stand in said stirrup to relieve tension in a section of said first strap below said first location such that said user can disconnect said first connector from said harness after said fall; and a shock pack attached to said fall arrest lanyard;

wherein said second connector comprises a second strap, wherein said second strap comprises a first terminal end secured to a distal end of said first strap and a second terminal end configured for attachment to said secure point; and wherein said first terminal end of said second strap is secured to said distal end of said first strap by a sewn loop through which said distal end of said first strap is looped to allow said first strap to slide through said sewn loop to deploy said etrier during said fall.

16. The fall arrest lanyard of claim 15, further comprising an anchor point located above said first location when said user is standing in said stirrup and when said second terminal end is attached to said secure point.

17. The fall arrest lanyard of claim 16, wherein said anchor point is located within reach of said user when said user is standing in said at least one stirrup and said second terminal end is attached to said secure point, thereby allowing said user to attach a rescue line to said anchor point so, upon disconnecting said fall arrest lanyard from said harness, said user can use said rescue line to escape in a controlled descent from a suspended position after said fall.

* * * * *